United States Patent [19]

Cappotto

[11] 3,957,150

[45] May 18, 1976

[54] IMPRESSION CONTROL APPARATUS FOR TYPEWRITERS

[75] Inventor: Samuel D. Cappotto, Syracuse, N.Y.

[73] Assignee: SCM Corporation, New York, N.Y.

[22] Filed: Jan. 8, 1975

[21] Appl. No.: 539,490

[52] U.S. Cl. ..... 197/17; 197/16

[51] Int. Cl.[2] ..... B41J 23/08

[58] Field of Search ..... 197/17, 16, 98

[56] References Cited

UNITED STATES PATENTS

| | | | |
|---|---|---|---|
| 2,902,131 | 9/1959 | Ascoli et al. | 197/17 |
| 3,164,237 | 1/1965 | Cappotto | 197/17 |
| 3,578,128 | 5/1971 | Frechette et al. | 197/17 |
| 3,616,887 | 11/1971 | Anderson | 197/17 |
| 3,642,109 | 2/1972 | Cappotto et al. | 197/17 |
| R25,011 | 7/1961 | Barkdoll | 197/17 |
| R25,024 | 8/1961 | Barkdoll | 197/17 |

*Primary Examiner*—Edgar S. Burr
*Assistant Examiner*—Edward M. Coven
*Attorney, Agent, or Firm*—Kenneth W. Greb; Milton M. Wolson

[57] ABSTRACT

A drive system for an electric typewriter has a power roll driven by an electric motor through a drive belt and a pulley rotatably mounted and resiliently connected to the power roll. The driving energy transmitted to the type action of the machine is controlled by energy-absorbing means adjustably connected to the power roll pulley and controlled through appropriate linkage by the machine operator to vary the energy absorbed by the resilient connection between the power roll and the pulley. A self adjusting means is also provided to set the proper tension on the drive belt of the drive system.

23 Claims, 6 Drawing Figures

IMPRESSION CONTROL APPARATUS FOR TYPEWRITERS

BACKGROUND OF THE INVENTION

1. Field of the Invention

This invention relates to drive systems for electrically-powered typewriters and, more particularly, to the selective control of the impression or typing density of such machines.

2. Description of the Prior Art

Adjustment of the driving force delivered to the typing action in electrically-powered typewriters and other business machines is necessary in order to control the impression made by the typebar of the machine on the paper for variation thereof with respect to the number of carbon copies. The accurate control of the energy is a difficult task which has required substantial effort on the part of business machine manufacturers. Prior attempts to control the drive forces transmitted to the typing action have included adjustable intermediate pulleys between the power roll of the machine and the drive motor for the machine, such as U.S. Pat. No. R. 25,024, to vary the speed at which the power roll rotates and thus vary the energy imparted to the typebar by the power roll. This pulley arrangement increases the wear and tear on the drive elements as well as the motor and requires additional costly components. Other approaches have included providing lost motion kinematic connections between the various links of the typing action, such as U.S. Pat. No. 3,578,128, to alter the effective paths of travel of the various members of the typing action and thereby control the initial velocity of the typebar. These lost motion linkage arrangements require substantial amounts of sliding movement between the various linkages in the typing action thus adding to the wear thereof and increasing the cost and complexity of the structure. Another problem with the lost motion linkages is that an individual linkage must be provided for each key so that this arrangement is relatively complex, expensive and sensitive to malfunction.

SUMMARY OF THE INVENTION

To overcome the problems heretofore encountered in the prior art in selectively controlling the impression of the type action of electrically-driven typewriters, the present invention sets forth a drive system having a power roll driven by an electric motor through a drive belt and pulley. The pulley is rotatably mounted and resiliently connected to the power roll. The resilient connection provides an energy-absorbing means which is adjustably connected to the power roll pulley and controlled through appropriate linkage by the operator of the machine in order to vary the energy absorbed by the resilient connection between the power roll and the power roll pulley. The drive system also includes self adjusting means to set the proper tension of the drive belt in the drive system.

Accordingly, in view of the above, it is an object of the present invention to provide a drive system for typing actions wherein the impression of type produced by the typewriter can be selectably controlled by the operator.

Another object of the present invention is to provide apparatus for driving the typing action of a typewriter wherein the effective power stroke of the typing action can be selectively varied.

A further object of the present invention is to provide apparatus for driving the typing action of a typewriter which is of a relatively simplified construction, having few moving parts, being durable and inexpensive to manufacture.

It is a further object of the present invention to provide a belt tension adjusting means for use on the belt drive of a typewriter which is self adjusting to set the desired tension and which is quiet running and relatively inexpensive.

Other objects and advantages will be apparent from the following description of an embodiment of the invention, and the novel features will be particularly pointed out hereinafter in connection with the appended claims.

DESCRIPTION OF THE PREFERRED EMBODIMENT

Figure 1:
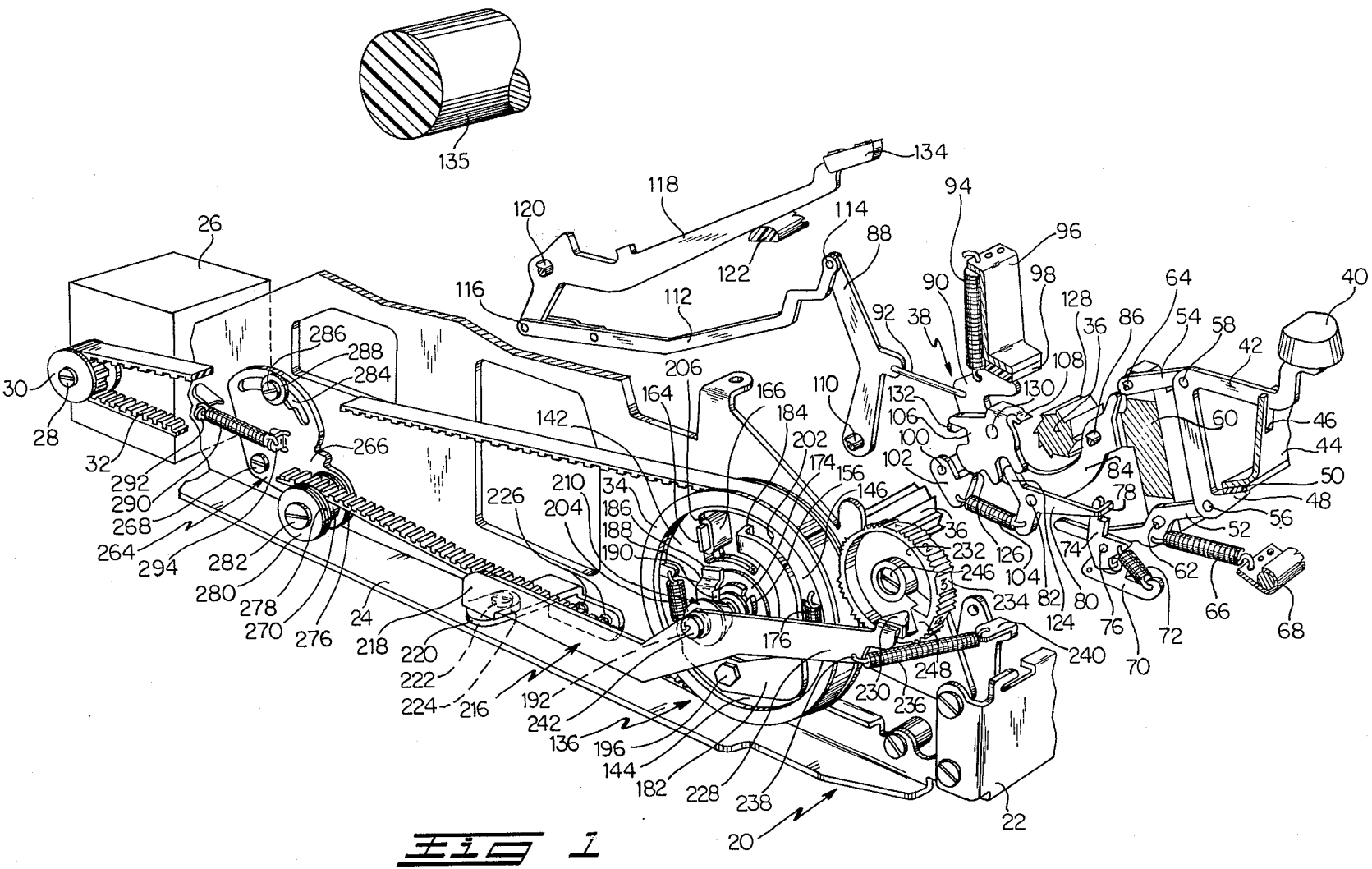
FIG. 1 is a partial view, in perspective, of an electric typewriter showing the type action and the apparatus for driving and controlling the type action, built in accordance with the teachings of the present invention.

Referring to FIGS. 1 through 6 and particularly to FIG. 1, the drive elements and typing action elements of a typewriter are shown mounted in a main frame 20 having a front plate 22 and a side plate 24. A power source in the form of a motor 26 has an output shaft 28 driving a pulley 30 counterclockwise to drive a timing belt 32 which in turn rotates a pulley 34 to drive a power roll or toothed snatch roll 36 which provides driving force to a powered type action 38. This power type action 38 is described at length in U.S. Pat. No. R. 25,011 and will be briefly described to show its relationship to the power transmission system of the present invention.

The powered type action 38 has a type key 40 connected to a key stem 42 which is positioned in a guide comb 44 so as to oscillate between its lowest point of travel when the key stem 42 contacts a key stop 46 and its upper point of travel when a bottom shoulder 48 of the key stem 42 contacts a silencing pad 50 assembled to the guide comb 44. The key stem 42 is pivoted on lower and upper key stem support links 52 and 54 respectively at lower and upper pivot points 56 and 58 respectively. The key stem support links 52 and 54 are pivoted to a fulcrum bar 60 at lower and upper pivot shafts 62 and 64 respectively. A key restoring spring 66, connected to lower key stem support link 52 and to a spring anchor 68, urges the type key 40 to the upper position until the bottom shoulder 48 of key stem 42 abuts silencing pad 50 of the guide comb 44.

A link extension tab 70 on the lower key stem support link 52 is connected through a spring 72 to a tripping trigger 74 which is mounted by pivot pin 76 on the lower key stem support link 52. The upper end of tripping trigger 74 contacts the forwardmost ear 78 of a pawl rocking lever 80 which, in turn, is pivotally mounted by a pivot pin 82 to a toggle link 84 which, in turn, is pivotally mounted on a fulcrum bar 86.

The toggle link 84 is connected to a typebar sublever 88 at its remote end 90 by a link 92. One end of a return spring 94 is connected to the toggle link 84 at the remote end 90 and the other end to a stop bar 96 to urge the toggle link 84 upward until it rests against cushion pad 98 assembled to the stop bar 96. Also connected at pivot pin 100 to the toggle link 84 is a rocking cam 102. The rocking cam 102 is also connected to the pawl rocking lever 80 by a return spring 104. A drive pawl 106 is pivotally carried by the toggle link 84 and is provided with an engaging tooth 108.

The typebar sublever 88 is pivotally mounted on the frame 24 by a shaft 110. Typebar sublever 88 is connected to a typebar link 112 by a pivot pin 114. The typebar link 112, in turn, is connected by a pivot pin 116 to a typebar 118 which is pivoted to the frame 24 of the typewriter by a shaft 120. The typebar 118 is shown in its rest position on a typebar rest 122.

Operation of the typing action is initiated by depressing the type key 40 which, in turn, causes the lower key stem support link 52 to pivot thereby raising the link extension tab 70 and carrying upwardly with it the tripping trigger 74 thereby pivoting the pawl rocking lever 80 counterclockwise about the pivot pin 82. A rearward extension 124 of the pawl rocking lever 80 engages and pivots the drive pawl 106 toward engagement with the teeth of the power roll 36. The rocking cam 102 is biased by the spring 104 against a cam surface 126 of the drive pawl 106 for pivoting engaging tooth 108 of the drive pawl 106 into full engagement with one of the teeth 128 of the power roll 36. The drive pawl 106 is pivoted clockwise about a pivot pin 130 until it rests against a stop 132 formed from the toggle link 84. The power roll 36 then drives the engaging tooth 108 being carried by the toggle link 84 in an arc about the shaft 86 until the engaging tooth 108 leaves a smaller arc formed by the teeth of the rotating power roll 36.

The toggle link 84, when pivoted about the shaft 86, works against the typebar return spring 94, and the downward movement of toggle link 84 causes the typebar sublever 88 to pivot about the shaft 110 which, in turn, translates the typebar link 112 to cause the typebar 118 to pivot about the shaft 120 until the type head 134 strikes a paper on a platen 135 of the typewriter.

The typebar return spring 94 will raise the toggle link 84 and thereby, through link 92, sublever 88, and typebar link 112, cause the typebar 118 to return to the rest position against typebar rest 122.

Power from the motor 26 is transferred to the power roll 36 of the typewriter by energy transmitting means consisting of a timing belt 32 which drives energy transmission means generally indicated at 136.

Figure 2:
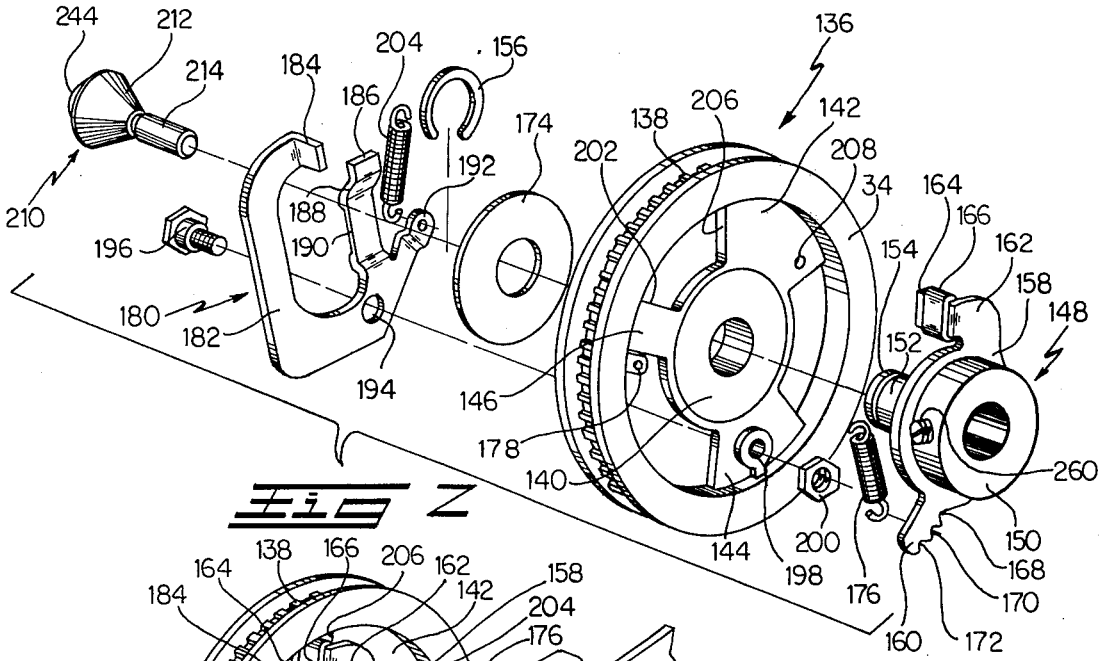
FIG. 2 is an exploded view, in perspective, of a portion of the apparatus for controlling the type action shown in FIG. 1.
Figure 3:
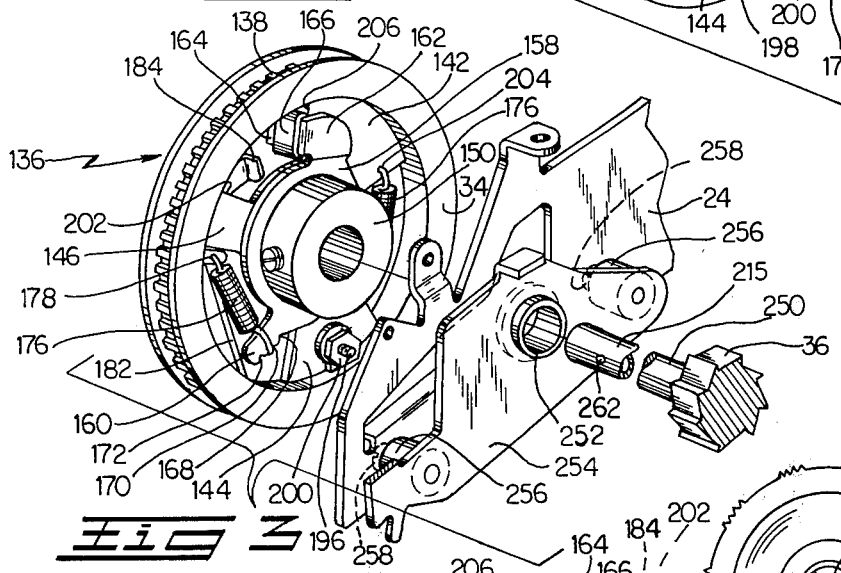
FIG. 3 is a view, in perspective, of the apparatus of FIG. 2 in assembled form and showing the relationship of the power roll of the machine to the assembled apparatus.

Referring now to FIGS. 2 and 3, the energy transmission means 136 consists of the pulley 34 in the form of a fly wheel having a toothed rim 138 for driving engagement with the timing belt 32. Of course, any other type of pulley and belt arrangement could be used. The rim 138 of the pulley 34 is connected to a hub 140 by means of three webs, a bumper stop web 142, an adjuster plate web 144 and a third web 146.

The pulley 34 is mounted via its hub 140 on an extension bushing 148 consisting of a locking collar 150 having a forward tubular extension 152 which is provided with a groove 154 for receiving a "*c*" ring 156. A power roll drive plate 158 is affixed to the extension bushing 148 adjacent extension 152 and includes a pair of oppositely directed radial arms 160 and 162. The free end of the arm 162 is formed to provide a lateral extension bumper 164 which carries a resilient pad 166. The other arm 160 has spring holding means which maybe, as shown, simply notches 168, 170, 172.

When assembled on the pulley 34, the tubular extension 152 provides a rotational bearing surface and extends through the hub 140 and is laterally retained intermediate the inner surface of the power roll drive plate 158 and a washer 174 by the *c* ring 156.

The pulley 34 is resiliently connected to the extension bushing 148 by means of a control spring 176, which is attached at one end to an ear 178 on the rim 138 of pulley 34 and at the other end to one of the notches 170 on the arm 160. The other notches 168 and 172 are positioned radially along arm 160 to vary the position of the control spring 176 to thereby selectively adjust the amount of energy absorbed by the control spring 176 for a given angular displacement between the extension bushing 148 and the pulley 34.

An impression adjuster plate 180 is a generally D-shaped plate whose ends are spaced apart. The upper end of one cross arm 182 is bent inwardly to form an adjuster stop 184. An opposed upstanding arm 186 is formed intermediate of its ends, with an outwardly directed portion 188 so that its edge 190 can function as a cam follower. Extending angularly and laterally from the lower end of the cam follower arm 186 is a spring retaining tab 192. Proximate the juncture of the tab 192 and the arm 168, there is provided a mounting passageway 194 for receiving a mounting screw 196 to pivotably attach the impression adjuster plate 180 to the pulley 34. The mounting screw 196 extends through a mounting boss 198 formed on one side of the adjuster plate web 144 and held in place by a locking nut 200. The adjuster stop 184 is urged toward an adjacent edge 202 of the third web 146 by an impression adjuster control spring 204 which is connected intermediate the tab 192 and an eye 208 formed in the bumper stop web 142.

Any relative rotational displacement between the pulley 34 and the extension bushing 148 is limited in one direction by means of the lateral extension bumper 164 engaging an adjacent edge 206 of the bumper stop web 142. Relative movement of the extension bushing 148 in the other direction, namely toward third web 146, is limited by contact between extension bumper 164 and the adjuster stop 184 of impression adjuster plate 180.

A control cam 210 which consists of head portion in the form of a conical camming surface 212 and a shank 214 is adapted to slidably fit within a tubular extension 215 of the power roll 36. Movement of the control cam 210 inwardly will cause the conical camming surface 212 to bear against the cam follower edge 190 and thereby pivot the impression adjuster plate 180 about the screw 196 causing the adjuster stop 184 to move toward the extension bumper 164. Opposite movement of the control cam 210 in an outward direction will allow the impression adjuster plate 180 to be pivoted under the influence of the control spring 204 and thereby move impression adjuster stop 184 away from the extension bumper 164.

With reference to FIG. 1, axial movement of the control cam 210 toward and away from the tubular extension 215 is via a lazy "*s*" shaped control arm 216. One end 218 of the control arm 216 is pivotably connected to a bracket 220 by a shoulder screw 222 and an arm flange 224. The bracket 220 is, in turn, rigidly assembled to the side plate 24 by screws 226. The other end 228 of the control arm 216 terminates in a cam follower tab 230 which bears against a circular cam surface 232 carried on a rotatable adjusting wheel 234. The end 228 is inwardly biased toward the cam surface 232 by a spring 236 which is supported between an arm anchor 238 and a frame anchor 240. Intermediate the ends of the control arm 216 there is provided a plastic thrust bearing 242 extending through the control arm 216 and abutting an end face 244 (FIG. 2) of the control cam 210. The adjusting wheel 234 is rotatably mounted to the side plate 24 by a shouldered screw 246. Rotation of the adjusting wheel 234 will therefore cause the cam follower tab 230 to move inwardly or outwardly limited by means of a stop 248 formed on the camming surface 232. Thus, as control arm 216 pivots inwardly, the plastic thrust bearing 242 drives the control cam 210 into the tubular extension 215. When control arm 216 pivots outwardly, the control cam 210 is free to move therewith under the force exerted by the control spring 204 biasing cam follower edge 190 of the impression adjuster plate 180 against the camming surface 212 of the control cam 210.

Referring to FIGS. 2 and 3, the entire energy transmission means 136 is supported on a power roll shaft extension 250 which passes through a bearing 252 carried by an inner frame 254. The inner frame 254 is supported by the side plate 24 and spaced therefrom by spacers 256 and screws 258. The power shaft extension 250 extends into the locking collar 150 and is attached thereto by a set screw 260 seating in a notch 262.

Referring again to FIG. 1, when a type key 40 is depressed, the type action linkage previously described will cause the engaging head 108 of the drive pawl 106 to contact the teeth of the power roll 36. In trying to move the drive pawl 106 and consequently move the toggle linkage, the power roll 36 will meet with inertial resistance and additionally will be working against the spring force of the return spring 94. The resistance met by the power roll 36 will tend to slow the rotation of the power roll 36. However, the pulley 34, which is being driven directly by the motor 26 through the drive belt 32, will tend to rotate at its constant speed. Therefore, there will be a difference in the rotational velocity between the pulley 34 and the extension bushing 148.

Prior to actuating a key action, both the pulley 34 and the extension bushing 148 are directly connected by the extension bumper 164 contacting the edge 206 of the bumper stop web 142 and therefore rotate at the same speed.

The resistance experienced by the power roll 36 produces a relative angular displacement between the pulley 34 and the extension bushing 148, which displacement stretches the control spring 176 that constitutes the coupling there between, thereby absorbing a quantity of energy being delivered by the motor 26 to the extension bushing 148. This angular displacement between extension bushing 148 and the pulley 34, due to resistance encountered by the power roll 36, is limited by the abutment of the extension bumper 164 with the adjuster stop 184 of the impression adjuster plate 180, as the extension bumper 164 moves counterclockwise toward the third web 146. Thereafter, the abutment of the extension bumper 164 with the adjuster stop 184 will provide a direct drive from the pulley 34 to the power roll 36.

The relative angular separation of control stop 184 and extension bumper 164 varies the energy which the control spring 176 may absorb during deceleration of the power roll 36. Upon contact of drive pawl 106 with the teeth of power roll 36, the rotational velocity of the power roll 36 is decreased and the final velocity thereof is dependent on the time it is permitted to decelerate. This time is a function of the separation between extension bumper 164 and control stop 184 and therefore the energy imparted to the typebar 118 and its subsequent impression is dependent on the final rotational velocity of the power roll 36 as the drive pawl 106 is driven outwardly thereof.

After contact between the drive pawl 106 and the power roll 36 is broken by the movement of toggle link 84 in the type action, the control spring 176 will release the energy previously absorbed and extension bushing 148 will rotate faster than the pulley 34 until extension bumper 164, moving in a relative clockwise direction, abuts the bumper stop web 142 of pulley 34 thereby eliminating the relative angular displacement between the pulley 34 and the extension bushing 148 and restoring the system to its rest position, ready for the next engagement of a drive pawl 106 with the power roll 36. When the contact between the drive pawl 106 and the power roll 36 is broken, approximately one-third on the flight (free flight) of the typebar 118 remains before the type head strikes the platen 135. Momentum carries the type head 134 into contact with a paper on the platen 135. During the free flight of the typebar 118, sufficient time is provided for the extension bumper 164 to return to its rest position against bumper stop web 142.

Figure 4:
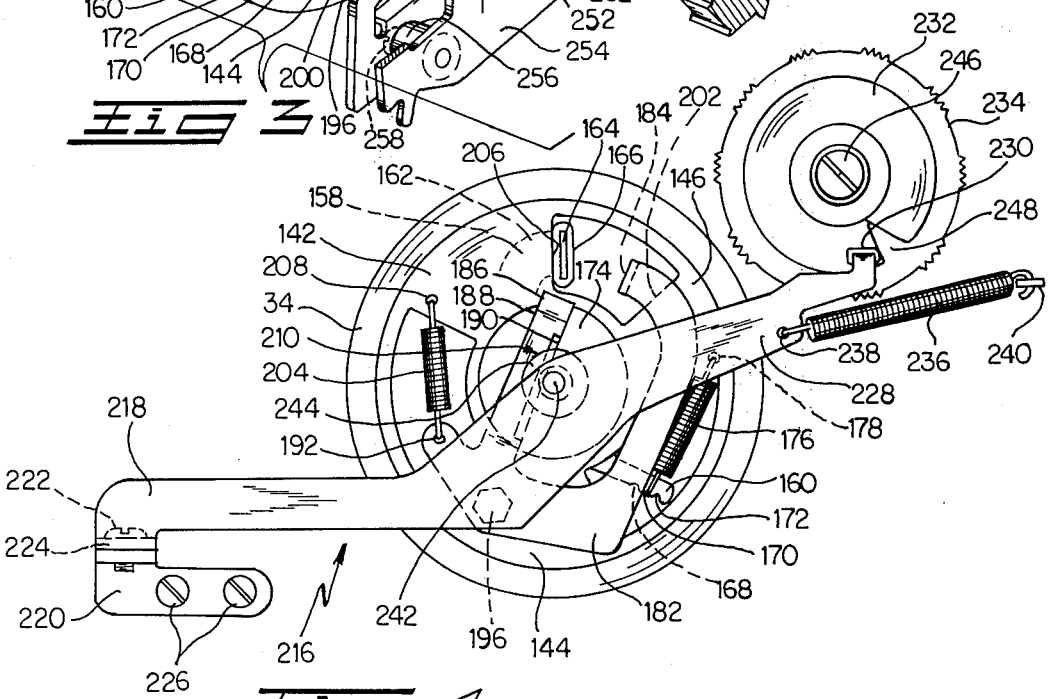
FIG. 4 is a view of the apparatus for driving and controlling the type action shown in FIG. 1, with the apparatus in the position for minimum type impression.
Figure 5:
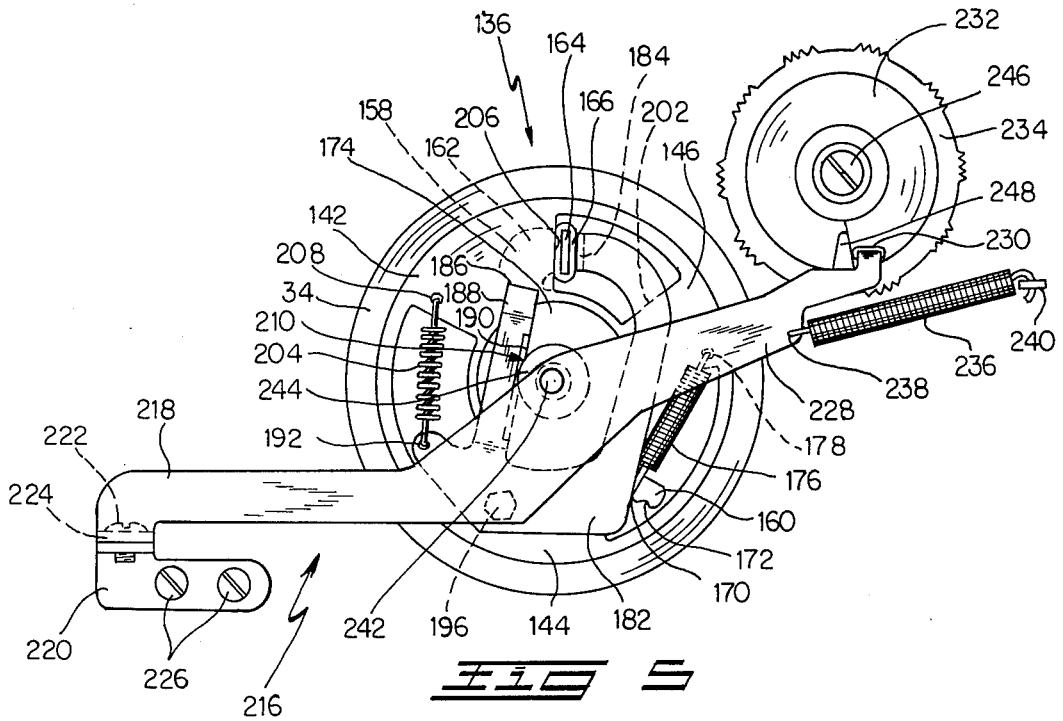
FIG. 5 is a view of the apparatus of FIG. 4 with the apparatus shown in the position for maximum type impression.

The amount of travel of the extension bumper 164 is limited by the adjuster stop 184 which is positioned by means of control of the control cam 210. As shown in FIG. 5, when the control cam 210 is positioned at one extreme sufficiently into tubular extension 215, it will move the cam follower arm 186 of adjuster plate 180 to pivot the adjuster plate 180 until the adjuster stop 184 is abutting extension bumper 164. In this position, there is no energy absorption between the pulley 34 and the power roll 36 at any point in the cycle of actuating a typebar 118. In FIG. 4, the control cam 210 is shown at its opposite extreme wherein the adjuster plate 180 will have pivoted to move adjuster stop 184 to its maximum spacing from extension bumper 164 which will thereby permit substantial extension of control spring 176 upon deceleration of the power roll 36, and accordingly, absorb a substantial amount of energy thereupon.

By varying the amount of stretch of the control spring 176 during deceleration, the amount of energy absorbed during the flight of the typebar 118 is varied. The amount of stretch of spring 176 is infinitely variable betwen the maximum and minimum limits of relative rotational travel of the extension bumper 164 toward adjuster stop 184. Selective rotation of adjusting wheel 234 positions the control cam 210, which, in turn, positions the adjuster stop 184. Further, as mentioned previously, the arm 160 has three separate notch positions for the control spring 176 so that a gross adjustment as to the maximum amount of energy to be absorbed by the control spring 176 for a given angular displacement of the power roll 36 relative the pulley 34 can be made at the factory which will enable the manufacturer to set the type action of the machine to compensate for differences in the quantity of energy required to produce suitable impressions for different styles of type, or for different purposes to which the machine is to be used.

The impression control for all of the typebars is selectively controlled by means of the simple impression control apparatus described, which, in turn, is dependent on constant or uniform rotation of pulley 34. Therefore, it is of importance for the proper functioning of the overall apparatus that tension for the drive belt 32 be properly set and should not be affected by minor variations in the production tolerance of the drive train apparatus. In order to insure proper drive belt operation, the apparatus includes a belt tensioning device generally indicated at 264 in FIG. 1.

Figure 6:
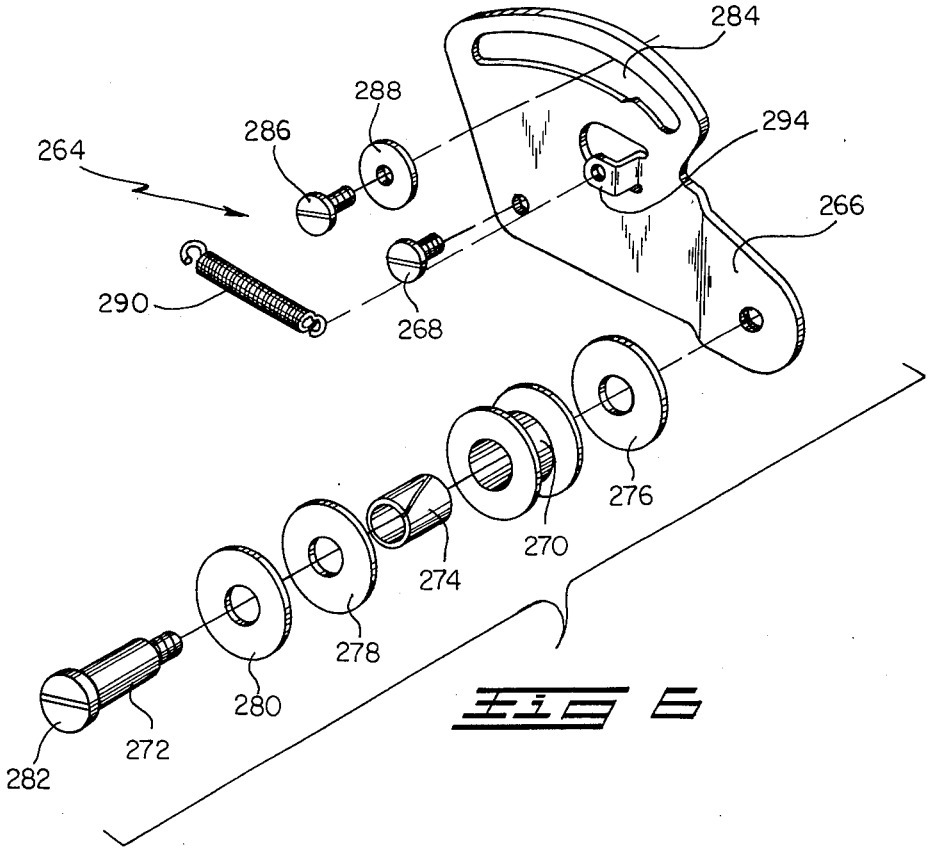
FIG. 6 is an exploded view, in perspective, of the apparatus for tensioning the drive belt shown in FIG. 1.

Referring to FIGS. 1 and 6, the belt tensioning device 264 consists of a bracket 266 pivotably connected to the side plate 24 by means of a shoulder screw 268. An idler pulley 270 is rotatably supported at the forward end of the bracket 266 by a shoulder screw 272. A felt tubular bushing 274 is positioned between the idler pulley 270 and the screw 272. A felt washer 276 is positioned between the idler pulley 270 and the bracket 266. Another felt washer 278 is positioned between the idler pulley 270 and a metal washer 280. When assembled (FIG. 1), the head 282 of the screw 272 is positioned against the metal washer 280 which sandwiches the felt washers 276 and 278 and the idler pulley 270 against the bracket 266 such that the idler pulley 270 is free to rotate. The felt tubular bushing 274 and felt washers 276 and 278 serve as silencers to minimize noise from the idler pulley 270 when the idler pulley is rotated by the timing belt 32. The bracket 266 has an arcuate slot 284 along its upper edge. A lock screw 286 extends through a washer 288, through the slot 284 and is threaded into the side plate 24. A tension spring 290 is connected at one end to a spring anchor 292 formed outwardly from the side plate 24 and is connected at the other end to a spring anchor 294 formed outwardly from the bracket 266.

To set the proper tension for the drive belt 32, the motor 26 is in an off condition (deenergized) and the lock screw 286 is loosened. The idler pulley 270 is then manually lifted upward, which is the same direction of the pull by the tension spring 290, until all slack is removed from the belt 32. The idler pulley 270 is then released and the tension spring 290 will locate the idler pulley 270 in a predetermined position to set the desired tension for the drive belt 32. Thus, the tension spring 290 acts as a self adjusting means for tensioning the drive belt 32. The predetermined position of the idler pulley 270 is maintained by tightening the lock screw 286.

Accordingly, it can readily be seen from the above that applicant's invention provides an efficient and effective method for adjusting the impression of type produced by a typewriter in a straightforward, uncomplicated, highly reliable manner. Note that no impression controls or adjustments are required for the individual type actions of the individual keys. All control is provided at one location which is easily accessible, and since the adjustment is made by absorbing energy before the printing takes place, the adjustment will be uniform for all of the type actions. Further, the apparatus itself is extremely simple, having relatively few moving parts, namely the extension bushing 148, the adjuster plate 180, the springs 176 and 204 connecting the extension bushing 148 and the adjuster plate 180 to the pulley 34 and the control cam 210 and control arm 216. Because of the simplicity of construction, the apparatus is relatively durable and maintenance free. Further, the apparatus offers a wide range of adjustment by repositioning the control spring 176 into one of the notches 168, 170 & 172 in the arm 160 thus providing one means for varying the amount of energy absorbed by the control spring 176. Another means for varying the amount of energy absorbed by the control spring 176 is provided by selectively positioning the adjuster stop 184 in one of its infinite number of fine settings relative to the extension bumper 164.

It should also be noted that the impression control device described does not in any way alter the path of the linkage but only adjusts the energy delivered to the various links at various points in their path of travel. Therefore, no lost motion linkages or sliding linkages are necessary to take up or shorten the travel of the various elements of the type action. Further, the impression control apparatus is directly driven from the power source of the machine and there are no intermediate pulleys or speed varying arrangements required.

The belt tensioning apparatus 264 of the invention insures that the timing belt 32 is operating at maximum efficiently. Since the entire impression control device is directly connected to the timing belt 32, the timing belt 32 coupling is somewhat more important than would normally be the case in a standard power-transmitting system. The belt tensioning device by insuring proper tension of the device avoids possible erratic operation of the type action due to changes in rotational speed of the power roll 36 that might be produced by a loose or slipping belt and also reduces the possibility of excessive noise and uneven wear on the belts and pulleys if the belt tension were too tight. The belt tensioning device is relatively simple and quiet in operation, and is relatively inexpensive to manufacture.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. An apparatus for controlling the driving energy transmitted to a typing mechanism of a typewriter comprising:

a motor;

a power roll;

the typing mechanism driven by said power roll when in engagement therewith and free from said power roll when disengaged therefrom;

energy transmitting means for transmitting energy from said motor to said power roll to drive the typing mechanism;

energy absorbing means operatively connected to said energy transmitting means for absorbing a portion of the energy transmitted by said energy transmitting means and retaining said portion of energy until after the typing mechanism disengages from said power roll without transmitting said portion of energy to the typing mechanism; and adjustable control means operatively connected to said energy absorbing means for controlling said portion of energy absorbed and thereby control the amount of the driving energy transmitted to the typing mechanism.

2. The apparatus according to claim 1 wherein:

said energy transmitting means comprise fly wheel means; and said energy absorbing means comprise connecting means rotatably and resiliently connecting said fly wheel means to said power roll for permitting relative angular displacement therebetween.

3. The apparatus according to claim 2, wherein said energy absorbing means further comprise spring means connected between said power roll and said fly wheel means to absorb energy upon relative angular displacement between said fly wheel means and said power roll.

4. The apparatus according to claim 3, wherein said energy absorbing means include means for adjusting the energy absorbed upon relative angular displacement between said fly wheel means and said power roll, comprising:

spring mounting means extending radially from the axis of rotation of said power roll, disposed on each of said fly wheel means and said power roll;

said spring mounting means on at least one of said fly wheel means and said power roll having a plurality of radially spaced positions for connecting said spring means to adjust the moment arm of said spring connection between said fly wheel means and said power roll.

5. The apparatus according to claim 3, wherein said adjustable control means for controlling said energy absorbing means comprise:

limit means operatively connected to said fly wheel means and said power roll for limiting the relative displacement between said fly wheel means and said power roll; and limit adjusting means operatively connected to said limit means for adjusting the position of said limit means to control the limit of relative displacement between said fly wheel means and said power roll.

6. The apparatus according to claim 5 wherein said limit means comprise:

a power roll contact member connected with said power roll to rotate in fixed relation to said power roll;

fly wheel stop means connected to said fly wheel means and positioned to contact said power roll contact member; and said limit adjusting means comprising position varying means to vary the relative position of said fly wheel stop means and power roll contact member.

7. The apparatus according to claim 6 wherein said position varying means comprise:

means movably connecting said fly wheel stop means to said fly wheel;

fly wheel cam means movably mounted with relation to said fly wheel means to move said fly wheel stop means in relation to movement of said fly wheel cam means;

said fly wheel stop means connected to said fly wheel cam means to rotate in fixed relation to said fly wheel means upon contact with said cam means; and cam positioning means for positioning said fly wheel cam means to adjust the position of said limiting means and thereby limit the displacement between said power roll and fly wheel means.

8. The apparatus according to claim 7 wherein said cam positioning means for positioning said fly wheel cam means comprise:

a control arm;

means connecting said control arm to said fly wheel cam means; and manual positioning means for manually positioning said control arm to position said fly wheel cam means.

9. The apparatus according to claim 8 wherein said manual positioning means for manually positioning said control arm to position said fly wheel cam means comprise:

manually positionable cam means mounted on said typewriter; and cam follower means on said control arm for positioning said control arm in response to the position of said manually positionable cam means.

10. The apparatus according to claim 9 wherein said energy transmitting means comprise:

belt means connecting said motor to said fly wheel means; and belt tensioning means to adjust the tension of said belt means.

11. The apparatus according to claim 10 wherein said belt tensioning means comprise:

idler means;

idler support means pivotally connected to said typewriter for supporting said idler; and resilient means connected to said idler support means for urging said idler means into tensioning contact with said belt.

12. The apparatus according to claim 11 wherein said idler means comprise:

axle means extending from said idler support means;

bushing means disposed about said axle means;

roller means disposed about said bushing means, said roller means having tapered shoulders at the ends thereof;

washer means disposed in contact with each of said shoulders of said roller means; and wherein said idler means further comprise locking means for fixing the position of said idler means with respect to said typewriter.

13. The apparatus according to claim 12, wherein said energy absorbing means include means for adjusting the energy absorbed upon relative angular displacement between said fly wheel and said power roll, comprising:

spring mounting means extending radially from the axis of rotation of said power roll, disposed on each of said fly wheel means and said power roll;

said spring mounting means on at least one of said fly wheel means and said power roll having a plurality of radially spaced positions for connecting said spring means to adjust the moment arm of said spring connection between said fly wheel means and said power roll; and spring means connected to said spring mounting means on said fly wheel means and said power roll.

14. In a typewriter having a frame with a typing mechanism and a motor for powering the typing mechanism mounted in the frame, the improvement of an apparatus for controlling the driving energy transmitted from the motor to the typing mechanism, comprising:

a power roll;

the typing mechanism driven by said power roll when in engagement therewith and free from said power roll when disengaged therefrom;

a pulley rotatably mounted with respect to said power roll;

a belt drive connecting the motor and said pulley to rotatably drive said pulley;

resilient means connecting said pulley to said power roll to allow relative displacement therebetween for absorbing a portion of the energy transmitted from said pulley to said power roll and retaining said portion of energy absorbed until after the typing mechanism disengages from the power roll for affecting the amount of driving energy transmitted to the typing mechanism; and adjustable control means connecting said pulley with said power roll to control the relative displacement between said pulley and said power roll for controlling the amount of energy absorbed.

15. The apparatus according to claim 14 wherein said resilient means connecting said pulley to said power roll to allow relative displacement between said pulley and said power roll comprise:

arm means extending radially from said power roll;

spring mounting means on said arm means;

spring mounting means on said pulley radially displaced from the axis of rotation of said pulley; and spring means connecting said spring mounting means on said arm and spring mounting means on said pulley.

16. The apparatus according to claim 15 wherein said resilient means connecting said pulley to said power roll to allow relative displacement between said pulley and said power roll include means to adjust the energy absorbed by said resilient means comprising a plurality of spring mounting points radially spaced on at least one of said spring mounting means on said pulley and said power roll spring mounting means.

17. The apparatus according to claim 14 wherein said adjustable control means connecting said pulley and said power roll to control the relative displacement between said pulley and said power roll comprise:

a power roll contact member connected to said power roll and radially disposed from the axis of rotation of said power roll;

an adjusting member movably connected to said pulley, adapted to rotate with said pulley and having a stop member disposed to contact said power roll contact member; and means for positioning said adjusting member to position said stop member with respect to said contact member of said power roll and thereby limit relative displacement between said pulley and said power roll.

18. The apparatus according to claim 17 wherein said means for positioning said adjusting member comprise:

pivot means radially disposed from the axis of rotation of said pulley connecting said adjusting member to said pulley; and a cam disposed at the axis of rotation of said pulley and in contact with said adjusting member to pivot said adjusting member in response to the position of said cam.

19. The apparatus according to claim 18 wherein said means for positioning said adjusting member further comprise:

said adjusting member cam disposed to move along the axis of rotation of said pulley; and spring means connected to said adjusting member and said pulley to urge said adjusting member into contact with said adjusting member cam.

20. The apparatus according to claim 19 wherein said means for positioning said adjusting member further comprise:

control arm means connected to said adjusting member cam to position said adjusting member cam;

manually controlled means for positioning said control arm means to position said adjusting member cam, said manually controlled means for positioning said control arm means comprising:

a selector wheel mounted on said typewriter;

a circular cam surface in said selector wheel;

cam follower means on said control arm means; and spring means connected to said control arm means to urge said cam follower means on said control arm means into engagement with said circular cam suruface on said selector wheel.

21. The apparatus according to claim 20 wherein said resilient means connecting said pulley to said power roll to allow relative displacement between said pulley and said power roll comprise:

arm means extending radially from said power roll;

spring mounting means on said arm means;

spring mounting means on said pulley radially displaced from the axis of rotation of said pulley; and spring means connecting said spring mounting means on said arm and spring mounting means on said pulley.

22. The apparatus according to claim 21 wherein said resilient means connecting said pulley to said power roll to allow relative displacement between said pulley and said power roll further comprise means to adjust the energy absorbed by said resilient means comprising a plurality of spring mounting points radially spaced on at least one of said spring mounting means on said pulley and said power roll spring mounting means.

23. The apparatus according to claim 22 further comprising:

a power roll extension extending along the axis of rotation of said power roll comprising:

an axle;

an axial passage in said axle; and said arm means extending radially from the axis of rotation of said power roll;

means fixedly connecting said power roll extension to said power roll;

and wherein said adjusting member cam comprises:

a conical camming surface;

a cylindrical surface mounted in and adpated to move in said axial passage in said axle of said power roll extension.

* * * * *